United States Patent [19]

West et al.

[11] Patent Number: 5,009,937

[45] Date of Patent: Apr. 23, 1991

[54] SAPSTAIN CONTROL COMPOSITION AND METHOD

[75] Inventors: Michael H. West, Senatobia, Miss.; Gregg Overman, Memphis, Tenn.

[73] Assignee: Chapman Chemical Company, Memphis, Tenn.

[21] Appl. No.: 403,924

[22] Filed: Sep. 7, 1989

[51] Int. Cl.[5] ..... B05D 7/06

[52] U.S. Cl. ..... 427/440; 106/18.3; 106/18.35; 428/541; 514/525

[58] Field of Search ..... 106/18.3, 18.35; 424/658; 427/440, 297; 428/541; 514/525

[56] References Cited

U.S. PATENT DOCUMENTS

| | | | |
|---|---|---|---|
| 3,901,935 | 8/1975 | Domenico | 558/413 |
| 4,069,342 | 1/1978 | Magee | 514/525 |
| 4,177,288 | 12/1979 | Gohlke | 514/500 |
| 4,461,721 | 7/1984 | Goettsche et al. | 106/18.3 |
| 4,911,988 | 3/1990 | Cass et al. | 106/18.3 |

FOREIGN PATENT DOCUMENTS

| | | | |
|---|---|---|---|
| 496907 | 10/1953 | Canada | 424/658 |
| 56-580 | 1/1981 | Japan | 514/525 |
| 56-81509 | 7/1981 | Japan | 424/658 |
| 2101487 | 1/1983 | United Kingdom | 514/525 |

*Primary Examiner*—Norman Morgenstern
*Assistant Examiner*—Terry J. Owens
*Attorney, Agent, or Firm*—Fred Philpitt

[57] ABSTRACT

A composition for controlling sapstain and mold on wood having 20% more of moisture comprises an aqueous solution containing at least 0.05% by weight of chlorothalonil and borax in a quantity between 3 and 9 times greater than the weight of the chlorothalonil. The composition is applied to wood by dipping or spraying.

6 Claims, No Drawings

SAPSTAIN CONTROL COMPOSITION AND METHOD

Wood is an excellent structural material for furniture and buildings and its appearance when used in these applications is pleasing if the wood has been protected from fungal discolorations. To protect wood from fungal discolorations chemicals are often applied to the wood surface before the air drying process. Once the wood dries below about 20% moisture content, fungal growth ceases, even in the absence of chemical protectants.

It is known that dispersions of chlorothalonil (tetrachloroisothalonitrile) are effective treatments for the protection of wood from stain and mold fungi during the drying process. It is also known that aqueous solutions containing at least five percent sodium tetraborate decahydrate (borax) are useful for preserving wood. In addition, it is known that many other chemicals including sodium pentachlorophenate and copper 8-quinolinolate are effective for protecting wood during the drying process. However, there is a continuing search for systems which provide complete protection at acceptable cost levels.

We have found that combinations of chlorothalonil and borax provide unexpectedly good levels of protection for wood from stain and molds at reduced levels of applications. Our discovery then relates to combinations and ratios of borax and chlorothalonil for protecting wood during the air drying process. Specifically, our invention relates to solutions of borax in water with chlorothalonil where the weight ratio of borax to chlorothalonil range from about 3 to 1 to about 9 to 1.

The composition of our invention may be applied by dipping the wood in a liquid bath or contacting the wood with a liquid spray containing our composition. In a dipping operation the chlorothalonil should constitute at least 0.05% by weight of the liquid, at least 0.2% by weight being preferred. As far as effectiveness is concerned, there is no upper limit for the weight % of the chlorothalonil, but cost considerations make it desirable to use the least amount which will satisfactorily control the sapstain. Solutions containing between 0.1% and 0.3% by weight of chlorothalonil based on the weight of the liquid have been found to be quite satisfactory for most dipping operations. The amount of borax is preferably about 3 to 9 times the weight of the chlorothalonil.

When spraying is used instead of dipping, the concentrations of the chlorothalonil and borax are preferably five to ten times higher than the concentration of these chemicals in a liquid dipping solution.

The compositions of the invention can be prepared by adding the borax and the chlorothalonil, either separately or together, to water and mixing to achieve solutions of the borax. It is preferable that the chlorothalonil be finely ground and contain dispersants to aid in mixing with water and to prevent settling. Anionic surfactants such as alkyl benzene sulfonates are preferred, although any surfactant that will disperse is satisfactory.

The following examples will serve to illustrate some preferred embodiments of the invention. All parts in said examples and elsewhere in the specifications and claims are by weight based on the total weight of the aqueous solution.

EXAMPLE I

In separate tests, five freshly cut southern yellow pine 1"×4"×18" boards of approximately 90% moisture content were dipped to on half their length in water containing:

(a) 0.1% chlorothalonil
(b) 0.1% chlorothalonil plus 0.3% borax
(c) 0.1% chlorothalonil plus 0.6% borax
(d) 0.1% chlorothalonil plus 0.9% borax
(e) 0.9% borax The boards were incubated in a room maintained at 85° F. and 65% relative humidity for six weeks at which time the boards were removed from the room and the treated ends visually compared with untreated ends in order to assign percentages of stain and mold control for each treatment. Average stain and mold control readings for each treatment are listed as follows:

| Treatment No. | % Stain Control | % Mold Control |
|---|---|---|
| (a) | 85 | 90 |
| (b) | 97 | 99 |
| (c) | 98 | 99 |
| (d) | 100 | 100 |
| (e) | 0 | 0 |

From the above data it is seen that whereas borax by itself was not effective for either stain or mold control at a concentration of as high as 0.9%, when combined with chlorothalonil in a quantity as little as 0.1% it dramatically improved both the stain and mold as compared with the use of chlorothalonil alone.

EXAMPLE II

Freshly cut red oak boards were dipped as in Example I in water solutions containing 0.2% chlorothalonil, then borax additions were made at levels from three to six times the chlorothalonil level. In each case, the borax additions improved the stain control from good to excellent when the boards were incubated as in Example I.

It is seen that the novel compositions of our invention present a means of unexpectably achieving almost total protection from stain and mold fungi during conditions favorable to fungal development.

We claim:

1. A method for controlling sapstain and mold on wood having 20% or more of moisture which consists of contacting wood with an aqueous solution containing (a) at least 0.05% by weight of chlorothalonil and (b) borax in a quantity between 3 and 9 times greater than the weight of the chlorothalonil.

2. A method according to claim 1 wherein the concentration of the chlorothalonil in the aqueous solution is 0.2% by weight.

3. A method according to claim 1 wherein the concentration of the chlorothalonil is about 0.1% by weight and the borax is between about 0.3% and about 0.9% by weight.

4. A composition for controlling sapstain and mold on wood having 20% or more of moisture which comprises an aqueous solution containing at least 0.05% by weight of chlorothalonil and borax in a quantity between 3 and 9 times greater than the weight of the chlorothalonil.

5. A composition according to claim 4 wherein the concentration of the chlorothalonil in the aqueous solution is 0.2% by weight.

6. A composition according to claim 4 wherein the concentration of the chlorothalonil is about 0.1% by weight and the borax is between about 0.3% and about 0.9% by weight.

* * * * *